US007255175B2

(12) United States Patent
Jackson et al.

(10) Patent No.: US 7,255,175 B2
(45) Date of Patent: Aug. 14, 2007

(54) FLUID RECOVERY SYSTEM AND METHOD

(75) Inventors: Thomas Roland Jackson, Conroe, TX (US); William Julius Jackson, Conroe, TX (US)

(73) Assignee: J&J Technical Services, L.L.C., The Woodlands, TX (US)

( * ) Notice: Subject to any disclaimer, the term of this patent is extended or adjusted under 35 U.S.C. 154(b) by 319 days.

(21) Appl. No.: 11/091,322

(22) Filed: Mar. 28, 2005

(65) Prior Publication Data

US 2006/0213661 A1 Sep. 28, 2006

(51) Int. Cl.
*E21B 43/00* (2006.01)

(52) U.S. Cl. ..... 166/369; 166/68.5

(58) Field of Classification Search ..... 166/369, 166/68.5, 105, 267
See application file for complete search history.

(56) References Cited

U.S. PATENT DOCUMENTS 3,775,030 A 11/1973 Wanner
3,884,598 A 5/1975 Wanner
4,086,036 A 4/1978 Hagen et al.
4,433,966 A 2/1984 Krumm
4,523,902 A 6/1985 Wally
5,080,560 A * 1/1992 LeRoy et al. ..... 417/172
5,188,515 A 2/1993 Horn
5,192,198 A 3/1993 Gebauer et al.
5,306,522 A 4/1994 Clough et al.
5,372,190 A 12/1994 Coleman
5,707,219 A 1/1998 Powers
6,017,198 A 1/2000 Traylor et al.
6,174,144 B1 1/2001 van Hamme et al.
6,595,280 B2 7/2003 Traylor

* cited by examiner

*Primary Examiner*—William Neuder
(74) *Attorney, Agent, or Firm*—Browning Bushman P.C.

(57) ABSTRACT

A fluid recovery system 10 for collecting formation fluid at the surface of a well 12 includes a downhole jet pump 20 and a surface diaphragm pump 40 having a plurality of diaphragms 42. The jet pump includes a fluid nozzle 22, an intake 24 directing the formation fluid into a jet 26, a mixing tube 28 for mixing the power fluid and the formation fluid, and a diffuser 30 for converting the velocity of the mixed fluid to pressure. A flow meter 50 and a pressure sensor 52 monitor the quantity and pressure of the power fluid to the jet pump.

20 Claims, 4 Drawing Sheets

FLUID RECOVERY SYSTEM AND METHOD

FIELD OF THE INVENTION

The present invention relates to a fluid recovery system for collecting formation fluid at the surface of a well. More particularly, the fluid recovery system utilizes a combination of a downhole jet pump and a diaphragm pump at the surface for pressurizing the power fluid to the jet pump.

BACKGROUND OF THE INVENTION

Various types of fluid recovery systems have been devised for collecting fluid from a formation at the surface of a well. In the petroleum recovery industry, a common fluid recovery system is a beam pump which reciprocates a rod passing through a tubing string to a downhole pump. Although beam pumps have been widely used in fluid recovery systems, they have inherent limitations which are becoming of increasing concern. Beam pumps by their very nature require a large amount of space and are typically quite noisy. Beam pumps also do not work well in highly deviated holes due to the wear inherent with the reciprocating rods. The rod string between the beam pump and the downhole pump is also expensive and contributes to tubing failures. A further disadvantage of rod-type pumps is that fluid under high pressure may bypass the closing valve and thus flow back toward the formation during the initial portion of the down stroke of the rod.

Another type of fluid recovery system for collecting formation fluid from a well utilizes an electric submersible pump. These pumps produce large volumes of fluids, but they have difficulty handling fluids with high solids content and/or fluids with a high percentage of gas. Electric submersible pumps are also expensive to install and maintain.

Some fluid recovery systems have utilized positive displacement or screw-pumps which utilize a rotating rod string. These pumps practically are limited to relatively shallow depths. The rotating rod string does not perform well in highly deviated wells, and also contributes to tubing wear.

One other type of fluid recovery system is referred to as a gas lift system. This system generally depends upon the injection of gas in the production string, and is expensive to operate, particularly when gas must be transported, compressed, and pumped into a well.

Jet pumps are currently used on a small percentage of wells to recover formation fluids. Jet pumps have significant advantages, but conventionally have required relatively expensive and high maintenance surface pumps to generate the power fluid for operating the downhole jet pump. An improved jet pump is disclosed in U.S. Pat. No. 5,372,190.

Some well operators have incurred the expense of a horizontal ESP (electric pumps) at the surface of a well to power a downhole pump. Horizontal ESP's are expensive, and also require a large amount of energy.

Diaphragm pumps have been used for various applications, including particularly those involving the pumping of chemicals, food products, and sewage. Diaphragm pumps are disclosed in U.S. Pat. Nos. 3,775,030, 3,884,598, 4,086,036, 4,433,966, 4,523,902, 5,188,515, 5,192,198, 5,306,522, 5,707,219, and 6,065,389. A diaphragm pump with two or more diaphragms is disclosed in U.S. Pat. No. 6,174,144. Diaphragm pumps have also been proposed as a downhole pump in a well, as evidenced by U.S. Pat. Nos. 6,017,198 and 6,595,280.

An improved fluid recovery system for collecting formation fluids at the surface of a well preferably utilizes a high reliability and relatively low cost downhole pump, and an efficient, relatively low cost, low maintenance and high reliability surface pump.

The disadvantages of the prior art are overcome by the present invention, and an improved fluid recovery system for collecting formation fluids at the surface of a well is hereinafter disclosed. The system utilizes an efficient downhole jet pump in combination with a surface diaphragm pump for passing the power fluid to the jet pump.

SUMMARY OF THE INVENTION

In one embodiment, the fluid recovery system for collecting formation fluid at the surface of a well includes a downhole jet pump and a diaphragm pump. The well includes an outer tubular, a production tubular positioned within the outer tubular, and an annulus between the outer tubular and the production tubular.

The downhole jet pump includes a fluid nozzle to convert pressure of the power fluid to velocity, an intake directing the formation fluid into a jet, and a mixing tube for mixing the power fluid and the formation fluid. A diffuser is provided for converting the velocity of the mixed fluid to pressure. A diaphragm pump at the surface is provided for powering a plurality of diaphragms to deliver the power fluid to the jet pump. A flow meter measures the quantity of power fluid from the diaphragm pump to the jet pump, and a pressure sensor monitors the pressure of the power fluid from the diaphragm pump to the jet pump.

These and further features and advantages of the present invention will become apparent from the following detailed description, wherein reference is made to the figures in the accompanying drawings.

DESCRIPTION OF THE PREFERRED EMBODIMENTS

Figure 1:
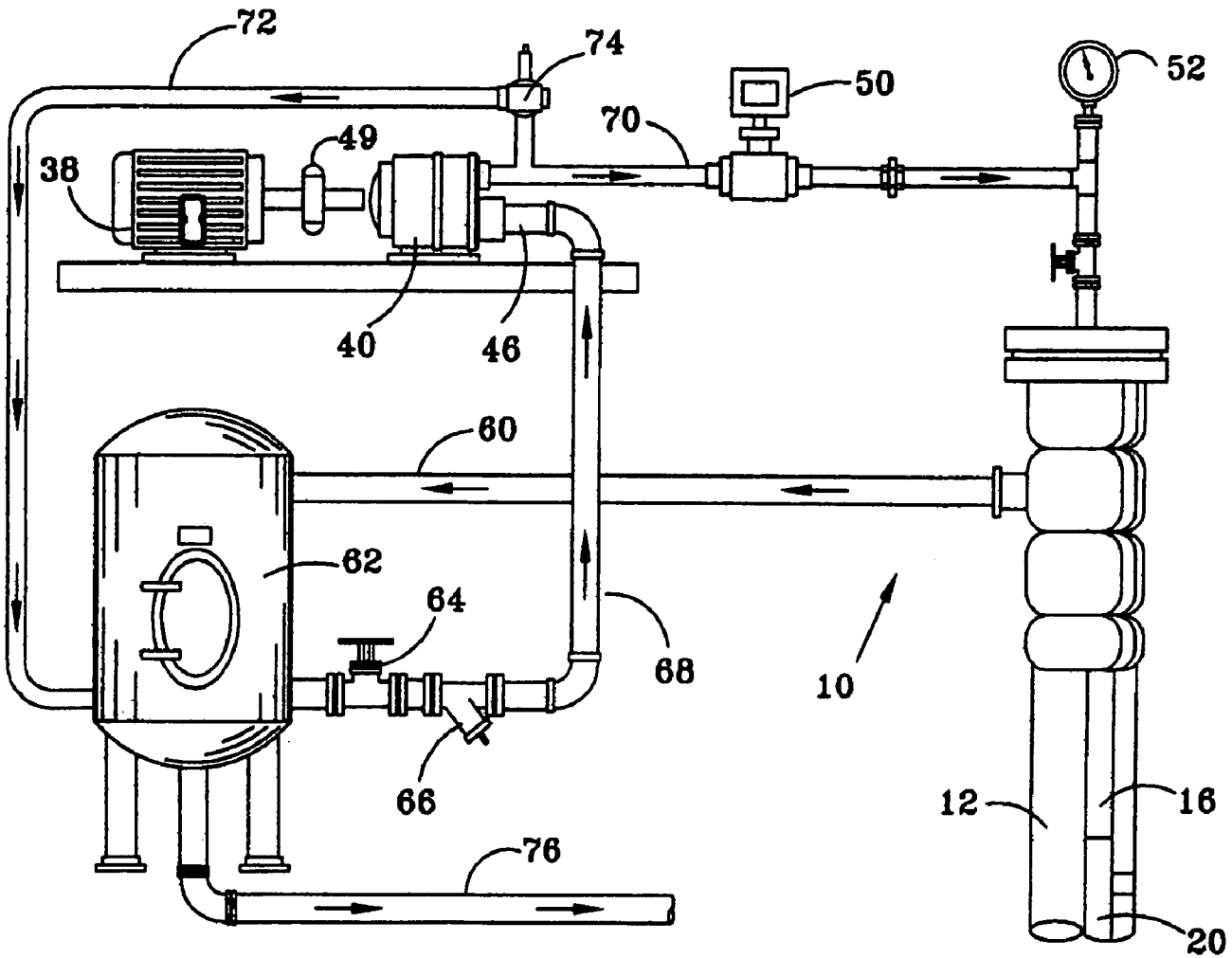
FIG. 1 illustrates one embodiment of a fluid recovery system according to the present invention utilizing a downhole jet pump and a surface diaphragm pump.

FIG. 1 depicts one embodiment of the fluid recovery system 10 according to the present invention for collecting formation fluid at the surface of a well including a casing 12. Production tubing 16 is positioned within the outer tubular or casing 12, thereby defining an annulus between the outer tubular 12 and the production tubing 16.

Figure 4:
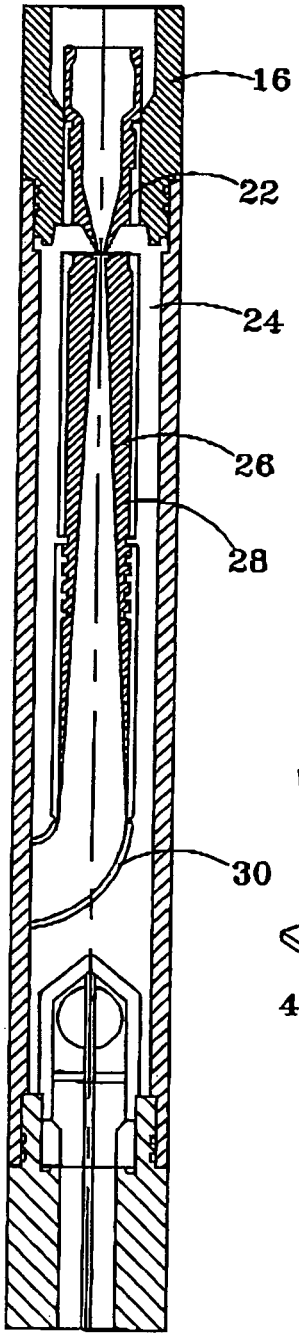
FIG. 4 is a simplified schematic representation of a suitable downhole jet pump.

System 10 as shown in FIG. 1 includes a downhole jet pump 20, which is shown in greater detail in FIG. 4. The jet pump 20 includes a fluid nozzle 22 to convert pressure of the power fluid to velocity, an intake 24 which directs the formation fluid into a jet 26, a mixing tube or throat 28 for mixing the power fluid and the formation fluid, and a diffuser 30 for converting velocity of the mixed fluid to pressure. For the embodiment as shown in FIG. 4, the power fluid thus passes down the interior of the production tubing 16. Formation fluid and power fluid are recovered at the surface through the annulus between the casing 12 and the production tubing 16.

Figure 5:
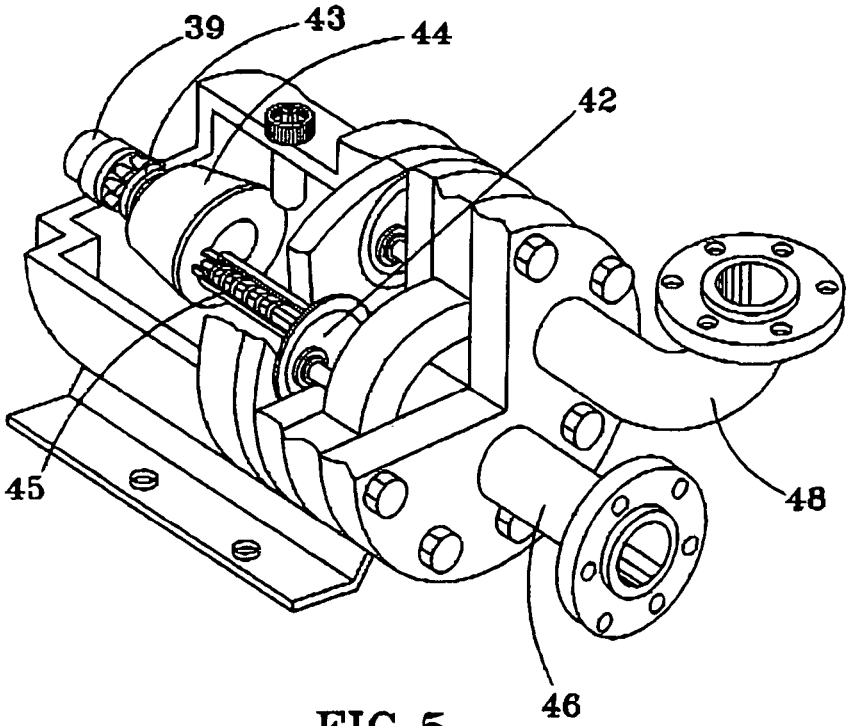
FIG. 5 is a simplified pictorial view of a suitable diaphragm pump.

FIG. 1 further depicts a diaphragm pump 40 provided at the surface of the well for delivering power fluid to the jet pump. A suitable diaphragm pump as shown in FIG. 5 includes a plurality of circumferentially spaced diaphragms 42. As shown in FIG. 1, an electrically powered motor 38 rotates shaft 39 of the diaphragm pump 40. Shaft rotation causes rotation of the bearings 43, which in turn rotates the wobble plate 44. Rotation of the wobble plate 44 moves five circumferentially spaced oil-filled piston assemblies 45, with each piston assembly in turn acting upon a respective diaphragm 42. Fluid thus enters the pump through the intake 46, and is discharged through outlet 48. As shown in FIG. 1, a rubber coupler 49 may be provided for coupling the motor shaft to the diaphragm pump shaft.

Referring again to FIG. 1, fluid recovered from the well may pass through line 60 to separating tank 62, which outputs water past the control valve 64 and the strainer 66 each in water line 68, which in turn is connected to the intake 46 to the diaphragm pump. Water is thus the power fluid for this embodiment, although oil, an emulsion of water and oil, or another available liquid may serve as the power fluid. The output from the diaphragm pump is split between line 70 which passes power fluid to the well and line 72 containing bypass valve 74 which returns a portion of the water to the separating tank 62, depending upon the desired flow rate to the well and the output from the diaphragm pump. The bypass line 72 and valve 74 thus selectively divert some of the power fluid from the jet pump. A flow meter 50 and a pressure gauge 52 are thus provided along power fluid line 70, so that the operator may monitor both the flow rate and the pressure of power fluid to the well, which in this case is provided to the interior of the production tubing string. Sales line 76 containing substantially hydrocarbons is thus output from the separating tank 62 as the desired recovered well fluid.

Figure 2:
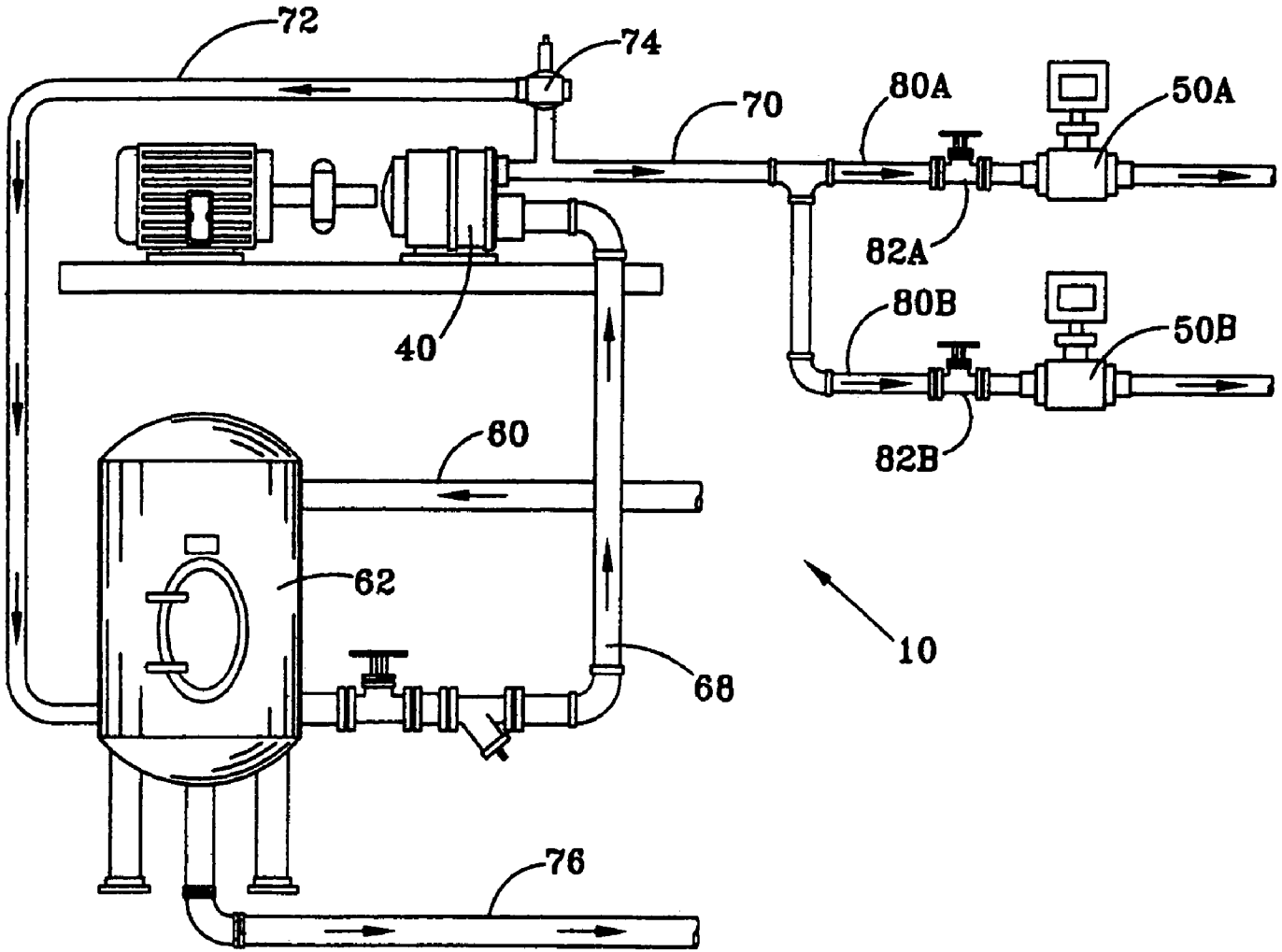
FIG. 2 is an alternative fluid recovery system wherein a single diaphragm pump is used to supply fluid to two or more downhole jet pumps each within a well.

FIG. 2 depicts an alternative system wherein the output of the diaphragm pump is again split downstream from the bypass line 72, so that the output from the diaphragm pump is effectively providing power fluid to a first wellhead through line 80A, with the fluid volume being controlled by valve 82A and monitored by flow meter 50A, while the parallel line 80B has fluid controlled valve 82B and flow meter 50B. By regulating the control valves 82A and 82B, as well as the bypass valve 74, the desired flow rate to each well may be obtained so that a single diaphragm pump 40 powers two jet pumps each within a respective well. An alternative system may use a single diaphragm pump to power more than two jet pumps each within a well.

Figure 3:
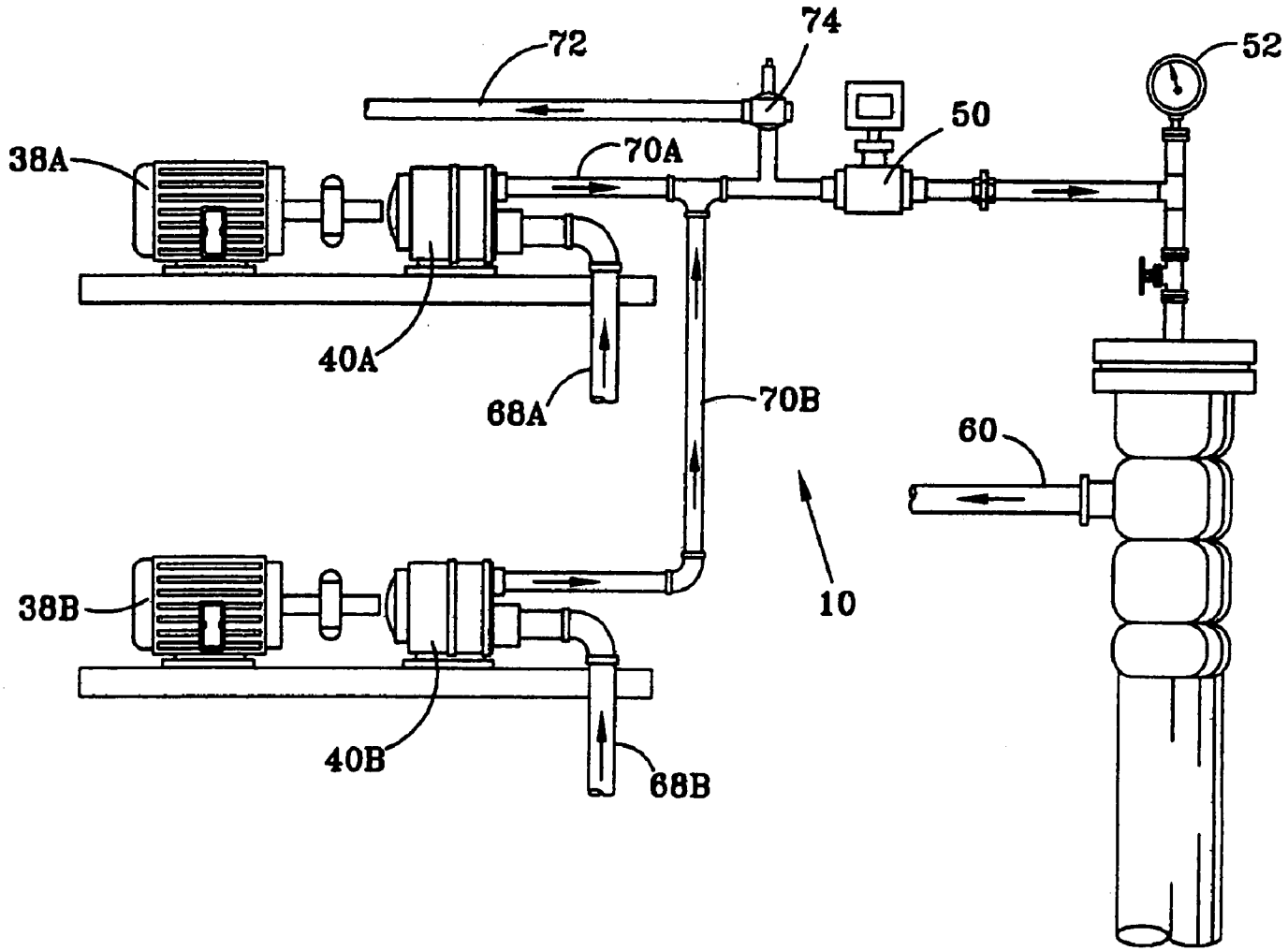
FIG. 3 illustrates an alternative fluid recovery system wherein two or more diaphragm pumps are used to deliver the power fluid to a jet pump.

FIG. 3 illustrates a system intended for supplying high pressure fluid to a jet pump. In this application, an electric motor 38A powers pump 40A, and a similar motor 38B powers pump 40B. Each pump receives power fluid from a respective line 68A, 68B. In this case, the output from pump 40A passes through line 70A, and is combined with the output from pump 40B passing through line 70B. A combination of two or more surface pumps may provide for a combined high volume output. Since pressure output by a diaphragm pump may increase with reduced flow output, two or more pumps in parallel provide a combined high volume, high pressure output. The bypass valve 74 may be located downstream from the combination of the outputs from the pumps, with flow meter 50 and pressure gauge 52 providing the desired flow and pressure indications to the operator, as previously discussed.

A highly efficient jet pump with a retrievable carrier is disclosed in U.S. Pat. No. 5,372,190. This jet pump provides a relatively large suction area by mixing the formation fluid and the power fluid so that the combined fluid flows to the surface through the annulus. The diaphragm pump as disclosed herein is highly efficient at powering a downhole jet pump, and is available at a significantly reduced cost compared, for example, to a piston type pump. A combination of diaphragm pump and the jet pump are also highly efficient, so that additional savings may be obtained by utilizing a reduced horsepower motor. The diaphragm pump is also highly reliable and requires little service or maintenance, which is particularly important for oilfield operations.

An efficient, relatively low cost, and highly reliable diaphragm pump requiring little maintenance is the Hydra-Cell diaphragm pump available from Warner Engineering, Inc. This pump provides five circumferentially spaced diaphragms powered by a rotating wobble plate, and is able to handle fluids with some abrasives. Most importantly, a diaphragm pump requires very little maintenance and is thus well suited for oilfield operations. A plurality of diaphragms each powered by a pump drive shaft are preferably used to generate the flow volume and pressure desired for the drive fluid.

In another embodiment, a variable speed motor may be provided for selectively controlling the speed of the diaphragm pump shaft and thus the flow output from the diaphragm pump. The motor may be connected with the diaphragm pump through a belt drive or a gear reducer, so that a direct connection between the motor shaft and the pump shaft is not required. Use of such a motor may obviate the need for a bypass line to regulate the flow of power fluid to the downhole jet pump. Also, a hydrocarbon powered engine may be used instead of an electric motor for driving the diaphragm pump.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A fluid recovery system for collecting formation fluid at the surface of a well, the well including an outer tubular, a production tubular positioned within the outer tubular, and an annulus between the outer tubular and the production tubular, the system comprising:

a downhole jet pump including a fluid nozzle to convert pressure of the power fluid to velocity, an intake directing the formation fluid into a jet, a mixing tube for mixing the power fluid and the formation fluid, and a diffuser for converting the velocity of the mixed fluid to pressure;

a diaphragm pump at the surface for powering the downhole jet pump, the diaphragm pump including a plurality of diaphragms for pressurizing the power fluid;

a flow meter for measuring the quantity of power fluid from the diaphragm pump to the jet pump; and a pressure sensor for monitoring the pressure of the power fluid from the diaphragm pump to the jet pump.

2. A system as defined in claim 1, wherein the power fluid is passed through the interior of the production tubular to the downhole jet pump, and wherein the mixed fluid passes to the surface through the annulus between the outer tubular and the production tubular.

3. A system as defined in claim 1, wherein the jet pump includes a carrier retrievable to the surface through the production fluid while a jet pump housing remains downhole.

4. A system as defined in claim 1, further comprising:

a separation tank at the surface for receiving the mixed fluid and separating hydrocarbons from water; and separated water from the separation tank passes to the diaphragm pump to generate the power fluid.

5. A system as defined in claim 4, further comprising:

a bypass line downstream from the diaphragm pump for diverting flow of power fluid from the downhole jet pump; and a bypass valve positioned along the bypass line for controlling the flow of bypass fluid diverted from the jet pump.

6. A system as defined in claim 1, further comprising:

a power source having a rotatable shaft for powering the diaphragm pump; and a wobble plate rotated by the shaft for powering the plurality of diaphragms.

7. A system as defined in claim 6, wherein the power source for powering the diaphragm pump is an electric motor.

8. A system as defined in claim 6, further comprising:

a plurality of pistons each between the wobble plate and a respective one of the diaphragms.

9. A system as defined in claim 1, further comprising:

the diaphragm pump supplying power fluid to two or more jet pumps each within a respective well.

10. A system as defined in claim 1, wherein two or more diaphragm pumps are positioned in parallel for powering the jet pump.

11. A fluid recovery system for collecting formation fluid at the surface of a well, the well including an outer tubular, a production tubular positioned within the outer tubular, and an annulus between the outer tubular and the production tubular, the system comprising:

a downhole jet pump including a fluid nozzle to convert pressure of the power fluid to velocity, an intake directing the formation fluid into a jet, a mixing tube for mixing the power fluid and the formation fluid, and a diffuser for converting the velocity of the mixed fluid to pressure;

a diaphragm pump at the surface for powering the downhole jet pump, the diaphragm pump including a plurality of diaphragms for pressurizing the power fluid;

a power source having a rotatable shaft for powering the diaphragm pump;

a wobble plate rotated by the shaft for powering the plurality of diaphragms;

a flow meter for measuring the quantity of power fluid from the diaphragm pump to the jet pump;

a pressure sensor for monitoring the pressure of the power fluid from the diaphragm pump to the jet pump;

a separation tank at the surface for receiving the mixed fluid and separating hydrocarbons from water; and separated water from the separation tank passes to the diaphragm pump to generate the power fluid.

12. A system as defined in claim 11, wherein the power fluid is passed through the interior of the production tubular to the downhole jet pump, and wherein the mixed fluid passes to the surface through the annulus between the outer tubular and the production tubular.

13. A system as defined in claim 11, further comprising:

a bypass line downstream from the diaphragm pump for diverting flow of power fluid from the downhole jet pump; and a bypass valve positioned along the bypass line for controlling the flow of bypass fluid diverted from the jet pump.

14. A system as defined in claim 11, wherein the power source for powering the diaphragm pump is an electric motor.

15. A system as defined in claim 11, further comprising:

a plurality of pistons each between the wobble plate and a respective one of the diaphragms.

16. A method of collecting formation fluid at the surface of a well, the well including an outer tubular, a production tubular positioned within the outer tubular, and an annulus between the outer tubular and the production tubular, the method comprising:

positioning a downhole jet pump of a lower end of the production tubular, including a fluid nozzle to convert pressure of the power fluid to velocity, an intake directing the formation fluid into a jet, a mixing tube for mixing the power fluid and the formation fluid, and a diffuser for converting the velocity of the mixed fluid to pressure;

providing a diaphragm pump at the surface for powering the downhole jet pump, the diaphragm pump including a plurality of diaphragms for pressurizing the power fluid;

measuring the quantity of power fluid from the diaphragm pump to the jet pump; and monitoring the pressure of the power fluid from the diaphragm pump to the jet pump.

17. A method as defined in claim 16, wherein the power fluid is passed through the interior of the production tubular to the downhole jet pump, and wherein the mixed fluid passes to the surface through the annulus between the outer tubular and the production tubular.

18. A method as defined in claim 16, further comprising:

providing a separation tank at the surface for receiving the mixed fluid and separating hydrocarbons from water; and separated water from the separation tank passes to the diaphragm pump to generate the power fluid.

19. A method as defined in claim 18, further comprising:

providing a bypass line downstream from the diaphragm pump for diverting flow of power fluid from the downhole jet pump; and positioning a bypass valve along the bypass line for controlling the flow of bypass fluid diverted from the jet pump.

20. A method as defined in claim 16, further comprising:

providing a power source having a rotatable shaft for powering the diaphragm pump;

providing a wobble plate rotated by the shaft for powering the plurality of diaphragms; and positioning a plurality of pistons each between the wobble plate and a respective one of the diaphragms.

* * * * *